US005464330A

United States Patent [19]

Prince et al.

[11] Patent Number: 5,464,330

[45] Date of Patent: Nov. 7, 1995

[54] CYCLIC HYDRAULIC PUMP IMPROVEMENTS

[75] Inventors: George T. Prince, Franklin; Mark J. Fisher, Menomonee Falls, both of Wis.

[73] Assignee: Applied Power Inc., Butler, Wis.

[21] Appl. No.: 28,491

[22] Filed: Mar. 9, 1993

[51] Int. Cl.[6] ..... F04B 3/00

[52] U.S. Cl. ..... 417/245; 417/273; 91/491

[58] Field of Search ..... 417/245, 246, 417/242, 254, 273, 456, 522, 539; 91/491

[56] References Cited

U.S. PATENT DOCUMENTS

| | | | |
|---|---|---|---|
| 1,868,498 | 7/1932 | Gruman . | |
| 2,702,008 | 2/1955 | Stockard | 103/168 |
| 3,053,186 | 9/1962 | Gondek | 103/5 |
| 3,276,673 | 10/1966 | Jones et al. | 417/246 |
| 3,597,121 | 8/1971 | McClocklin | 417/400 |
| 3,776,665 | 12/1973 | Dalton | 417/252 |
| 3,992,131 | 11/1976 | Masterman et al. | 417/206 |
| 4,105,369 | 8/1978 | McClocklin | 417/206 |
| 4,723,894 | 2/1988 | Marx | 417/269 |
| 4,761,118 | 8/1988 | Zanarini | 417/254 |
| 4,854,822 | 8/1989 | Darroch | 417/62 |

FOREIGN PATENT DOCUMENTS

| | | | |
|---|---|---|---|
| 837087 | 6/1960 | United Kingdom | 102/1 |
| 2013775 | 8/1979 | United Kingdom . | |

*Primary Examiner*—Richard A. Bertsch
*Assistant Examiner*—Alfred Basichas
*Attorney, Agent, or Firm*—Quarles & Brady

[57] ABSTRACT

A two stage pump has coaxial first and second stage reciprocating pumps with the second stage piston reciprocably driven by the first stage piston. Multiple sets of first and second stage pumps are provided, and the second stage pistons can be returned by supercharge pressure, a loose connection between the first and second stage pistons, or a spring. An accumulator which is charged on a compression stroke and discharged on an intake stroke may also be provided in communication with a pumping chamber to improve the efficiency of a pump.

6 Claims, 5 Drawing Sheets

CYCLIC HYDRAULIC PUMP IMPROVEMENTS

FIELD OF THE INVENTION

This invention relates to improvements in hydraulic pumps and in particular to cyclic hydraulic pumps.

DISCUSSION OF THE PRIOR ART

Two stage hydraulic pumps of the type capable of delivering a relatively high volume of flow at a relatively low pressure and a relatively low volume of flow at a relatively high pressure are well known and find many applications. For example, U.S. Pat. Nos. 3,053,186, 3,992,131 and 4,105,369 disclose such pumps.

In the pumps disclosed in these patents, the first stage, which is primarily responsible for delivering a relatively high volume at a low pressure, is a gear type pump in U.S. Pat. No. 3,053,186 and a gerotor type pump in U.S. Pat. Nos. 3,992,131 and 4,105,369. Gear pumps and gerotor pumps are well known in the art and in general use the action of meshing gears to pump hydraulic oil from the inlet to the outlet of the pump. The second or high pressure stage in the pumps in these patents is provided by a reciprocating piston type pump. As is common in these types of pumps, when the load pressure reaches a certain bypass pressure, the relatively high volume of the first stage is bypassed to tank.

First stage gear and gerotor type pumps, while they perform their intended functions in two stage pumps, lack efficiency in power conversion as compared to reciprocating piston type pumps. Inefficient utilization of the power delivered by the motor or other prime mover which drives the pump requires that the bypass pressure, the pressure at which flow from the first stage is relieved to tank pressure, be lower than it would be with a more efficient pump.

Also, gear and gerotor type pumps require the meshing of at least two precision gears for their proper operation. As a result, they are sensitive to damage or failure caused by contamination or cavitation of the hydraulic fluid they are pumping. Also, gear and gerotor type pumps sometimes operate at a noise level which is objectionable in some applications.

Also, with two stage pumps employing a first stage gear or gerotor type pump and a second stage reciprocating piston type pump, the mechanisms used for driving the two different stages are usually quite distinct from one another, although in many cases the same shaft is employed. However, the different types of mechanisms which must be employed to drive the two different types of pumps in the two stages require relative complexity, a relatively high number of parts and a relatively large package to house the two stages.

In addition, in cyclic hydraulic pumps such as reciprocating hydraulic pumps in which the pressure varies throughout a cycle of the pump, since hydraulic fluid is relatively incompressible, pressure is developed in the fluid very early in the compression phase of the cycle. Likewise, pressure drops off very quickly in the suction or intake phase of the cycle. Such rapid variations in pressure can lead to inefficiencies in the power usage of the pump.

In addition, the incompressibility of hydraulic fluid can cause the power capacity of the prime mover of a cyclic pump to be met at a relatively low pressure. The bypass pressure must be set to occur before the power capacity of the prime mover is met. When the bypass pressure is met, the bypass valve opens with a consequent relatively large drop in flow. The result is that after the bypass valve opens, only a relatively small fraction of available power is utilized for a significant range of pressures.

SUMMARY OF THE INVENTION

The invention provides a two stage hydraulic pump of the type having a first stage pump for delivering a hydraulic fluid flow of a relatively high volume and low pressure and a second stage pump for delivering a hydraulic fluid flow of a relatively small volume and high pressure which overcomes the above disadvantages. In a pump of the invention, the first stage pump is a reciprocating piston pump having a first stage piston reciprocable in a first stage cylinder, the second stage pump is a reciprocating piston pump having a second stage piston reciprocable in a second stage cylinder, and the second stage piston is driven by the first stage piston to compress the fluid.

This construction provides an efficient pump which can be made in a relatively small package, not significantly larger than a comparable single stage pump, and with fewer and less expensive parts than comparable first stage gear or gerotor type pumps. It also results in an improvement in efficiency in the first stage over a gear or gerotor type pump which correspondingly allows for higher bypass pressures and therefore more efficient overall operation. Also, a pump of the invention is less sensitive to damage caused by contamination or cavitation than a gear or gerotor type pump and is potentially more quiet in operation than typical gear or gerotor pumps.

In preferred aspects, the first and second stage pumps are substantially coaxial, multiple sets of first and second stage pumps are provided, the first stage pistons of the multiple sets are driven by a common shaft and the shaft has an eccentric lobe which drives the multiple first stage pistons. These aspects help provide a very compact unit with relatively few parts which can be efficiently and economically manufactured.

In other alternate preferred aspects, the second stage cylinder is supercharged with pressurized fluid to return it on a retraction stroke thereof, the first and second stage pistons are connected so that the second stage piston follows the first stage piston on its return stroke, or the second stage piston is spring biased toward the first stage piston. The first alternate is especially useful to reduce the number of parts of the pump and provide a simple mechanism for returning the second stage piston, but is only useful when the plumbing allows using the first stage output to supercharge the second stage cylinder. When such is not the case, either of the latter two alternates may be used.

In another aspect, an accumulator may be provided in communication with a pumping chamber of a hydraulic pump. In this aspect an accumulator may be applied to a single stage pump, but in the preferred form an accumulator is provided for each of the first stage cylinders of a two stage pump having multiple sets of first and second stage pumps. The accumulators reduce output flow from the first stage cylinders as the output pressure of the first stage pumps increases. As the flow output is decreased in this manner, the energy requirement from the prime mover which drives the first stage pistons is reduced by virtue of reduced pumping chamber pressures through the initial portion of the compression stroke of the first stage pistons and also by the return of energy to the crankshaft during the initial stages of the intake stroke when the accumulator discharges back into the first stage cylinder.

The accumulator allows increasing the bypass pressure for any given prime mover and allows utilizing a higher percentage of available power of the prime mover for a range of pressures approaching the bypass pressure. As compared to a gear or gerotor type pump, efficiency is particularly improved just below the bypass pressure (especially at higher bypass pressures) because rather than the output flow being reduced by leakage past the gear or gerotor teeth, it is reduced by accumulator action and much of the energy in charging the accumulator is returned to the crankshaft on the suction stroke of the first stage piston.

In addition, the performance curve of a pump utilizing an accumulator can be tailored to stay within power limitations of the prime mover throughout a certain pressure range while maximizing output flow by an appropriate selection of the springs which bias the accumulator, the surface area of the accumulator plunger and/or the stroke of the accumulator.

DETAILED DESCRIPTION OF THE PREFERRED EMBODIMENTS

Figure 1:
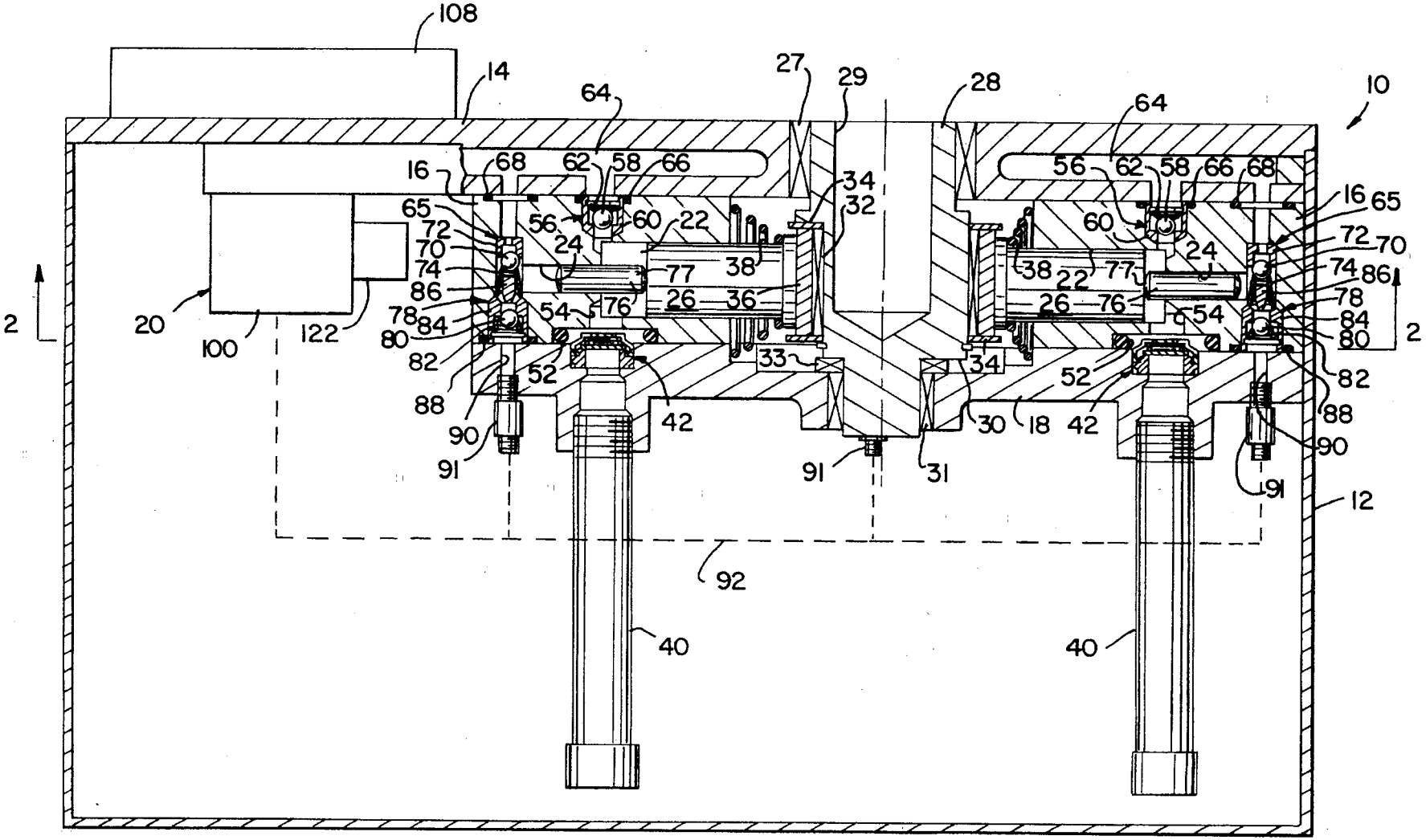
FIG. 1 is a cross sectional view of a two stage hydraulic pump of the invention taken along the line 1—1 of FIG. 2.
Figure 2:
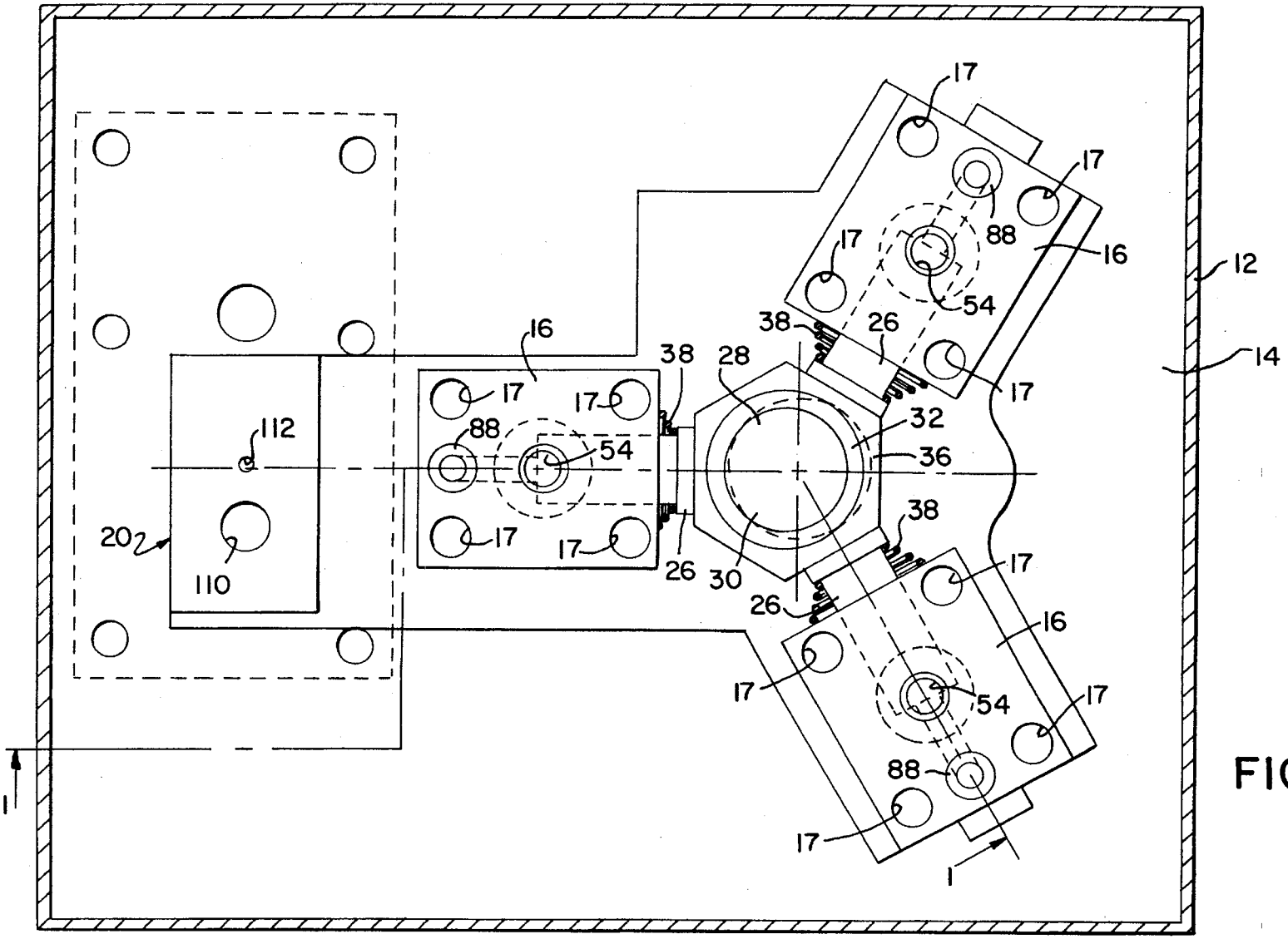
FIG. 2 is a bottom plan view of the pump of FIG. 1 as viewed along the line 2—2 of FIG. 1.
Figure 3:
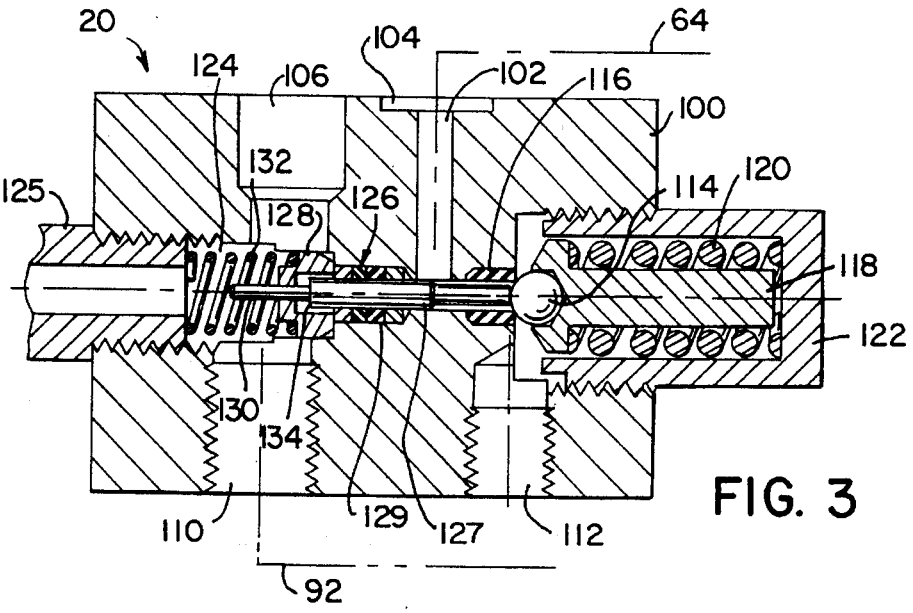
FIG. 3 is a schematic cross sectional view illustrating a bypass valve for the pump of FIG. 1.

Referring to FIGS. 1–3, a pump 10 includes a reservoir tank 12, a manifold plate 14, three cylinder blocks 16 fixed to the manifold plate 14, cover 18 fixed to the cylinder blocks 16 and bypass valve 20 fixed to the plate 14. The plate 14 seals off the open end of the tank 12 to contain a supply of hydraulic fluid within the tank 12 at a relatively low tank pressure. The pump 10 draws its supply of hydraulic fluid to be pumped to a load from the fluid contained within the tank 12.

Each cylinder block 16 is identical to the others and has bored in it four bolt holes 17 for mounting the block 16 to the plate 14, and the cover 18 also has corresponding holes for accommodating bolts to secure the cover 18 and blocks 16 to the plate 14. Each cylinder block 16 also has a first stage cylinder 22 of a relatively large diameter and a second stage cylinder 24 of a relatively small diameter which is coaxial with the first stage cylinder 22. Slideably received in each first stage cylinder 22 is a first stage piston 26 which is driven to reciprocate axially with respect to its corresponding cylinder 22 by a crankshaft 28.

The crankshaft 28 is journaled in manifold plate 14 by bearing 27 which is supported by the manifold plate 14 and by bearings 31 and 33 which are supported by the cover 18. The crankshaft 28 has an internal bore 29 which may be splined or otherwise suited to create a driving connection between the shaft 28 and a prime mover such as an electric motor for driving the pump 10. Alternately, an external gear, pulley or other suitable drive means could be provided for creating a driving connection with the crankshaft 28. The crankshaft 28 has an eccentric lobe 30 on which is journaled by radial bearing 32 and annular thrust washers 34 a piston drive sleeve 36. Each piston 26 is biased against the sleeve 36 by a conical compression spring 38. As the shaft 28 rotates, the pistons 26 are sequentially reciprocated in 120° phased relationship.

On the suction stroke of each piston 26, i.e. when the piston 26 is retracting from its associated cylinder 22, hydraulic oil is sucked through an intake pipe 40 (one pipe 40 for each cylinder 22) associated with the cylinder 22 and past fast acting one way check valve 42. Preferably, pipe 40 has a screen or filter 44 at its lower intake end.

Figure 1A:
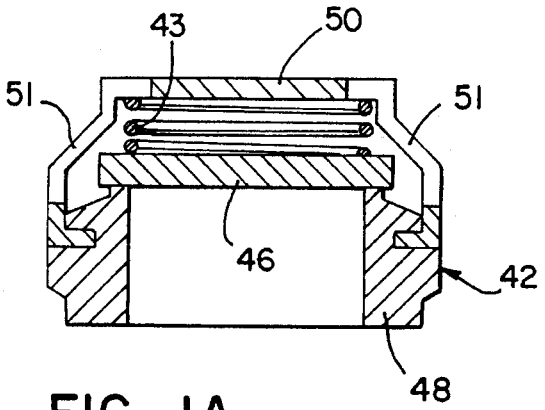
FIG. 1A is an enlarged cross sectional view of a fast acting intake check valve for a first stage cylinder of the pump shown in FIG. 1.

Check valve 42, best shown in FIG. 1A, is of a well known type which has a flat plate 46 biased by a compression spring 43 against a seat 48 with the spring 43 held in place by a sheet metal cap 50. The upper part of the cap 50 is perforated as at 51 so that when the plate 46 moves away from the seat 48, fluid flowing up through the intake pipe 40 can flow past the seat 48 and plate 46 and through the perforations 51 in the cap 50 into cylinder 22. An o-ring 52 (FIG. 1) provides a seal between each block 16 and the cover 18 and passages 54 are formed in the block 16 to provide communication between the check valve 42 and the inner end of the cylinder 22.

On the compression stroke of the piston 26, check valve 42 closes and one way check valve 56 of a well known ball type having a ball 58 biased against seat 60 by a conical compression spring 62 opens to allow fluid in the cylinder 22 which is being compressed by the piston 26 to flow past the check valve 56 and into passageway 64. Passageway 64 is common to and communicates with the outlets of each of the check valves 56 of each of the three first stage cylinders 22 and also communicates with the bypass valve 20 and the inlets of each check valve 65 for the three second stage cylinders 24, as more fully described below.

O-rings 66 seal the interface between the manifold plate 14 and the first stage cylinder outlet port and o-rings 68 seal the interface between the manifold plate 14 and the inlet port to the second stage cylinders 24. For each second stage cylinder 24, an inlet check valve 65 of basically the same type as check 56 resides in the inlet port, having a ball 70 which seats against a seat 72 and is spring biased against the seat 72 by a conical compression spring 74. A second stage piston 76 of a smaller diameter than the first stage piston 26 is received in each cylinder 24 and slideably reciprocable therein. The piston 76 is driven on its compression stroke by the first stage piston 26 abutting its end 77 which extends into the first stage cylinder 22.

The second stage piston 76 is driven toward the first stage piston 26 on its retraction stroke by pressure generated by the pistons 26 in the passageway 64. The pressure of the fluid in the passageway 64 is sufficient to open check valve 65 and enter cylinder 24 so as to return piston 76.

On the compression stroke of the piston 76, the pressure of the fluid within second stage cylinder 24 increases so as to close check valve 65 and open check valve 78. A check valve 78 is received in the outlet port of each second stage cylinder 24. Check valve 78 is of a well known type having a ball 80 biased by a conical compression spring 82 against seat 84. Seat 84 has a nose portion 86 which extends toward ball 70 to limit the movement of ball 70 away from seat 72, so that ball 70 is assured of reseating on the compression stroke of piston 76. An o-ring 88 seals the interface between the outlet port for each cylinder 24 and the cover 18. An outlet 90 is formed in the cover 18 for each second stage outlet port and all of the outlet passages 90 are connected to each other and to bypass valve 20 by nipples 91 and other suitable plumbing as schematically illustrated in FIG. 1 by dashed line 92.

It should be noted that all of the output of both the first stage pump and the second stage pump flows past the check valve 78. For low pressures in line 92, the output of the first stage pumps (cylinder 22 and piston 26) will open up the check valves 56, 65 and 78 and simply blow by them, while charging the second stage cylinder 24 so as to retract the second stage piston 76 from the second stage cylinder 24. Since the three sets of first and second stage pistons are in 120° timed relationship to one another, there is always at least one flow path open from passage 64 to line 92. Thus, for example, if the pistons 26 and 76 shown on the left in FIG. 1 are beginning their-compression strokes, at least one of the other two sets of pistons are either retracted or retracting. In any event, flow from the first stage piston 26 shown on the left of FIG. 1 would be directed through passageway 64 to be output through one of the check valves 78 other than the check valve 78 shown on the left of FIG. 1. Note that the flow from any one of the first stage pistons goes to help return the two second stage pistons not associated with the one first stage piston. This is the case because for much of the compression stroke of any first stage piston, the inlet check 65 of the associated second stage cylinder is closed, whereas at least one of the other two inlet checks 65 are open.

Turning now to the operation of the bypass valve 20 shown in FIG. 3, the bypass valve 20 has a valve block 100 which is bolted to the manifold plate 14. At the top side of the valve block 100 as viewed in FIG. 3, a low pressure inlet port 102 communicates with passageway 64. A counterbore 104 is formed in port 102 to receive an o-ring (not shown) for sealing against plate 14 and suitable passageways (not shown) are provided in plate 14 for providing communication between port 102 and passageway 64. Outlet port 106 also opens to the top surface of valve block 100 and suitable passageways (not shown) are provided through plate 14 and valve mounting pad 108 of plate 14 for communicating the outlet flow from the pump through port 106 to the exterior of the pump 10. Typically, a valve (not shown) would be mounted to pad 108 and in communication with port 106. Such valves are well known in the art and typically have a manual or automatic on/off control for controlling flow to a hydraulic pressure load which the pump 10 is intended to supply.

Opening to the lower surface of block 100 in FIG. 3 are an inlet port 110 and a tank port 112. The inlet port 110 is in communication with the three outlet ports 90 of the three second stage cylinders 24 via plumbing 92 and the outlet port 112 is in communication with the interior of tank 12.

As described above, below the bypass pressure which is set by valve 20 the output of both the first (cylinder 22 and piston 26) and second (cylinder 24 and piston 76) stage pumps flows through plumbing 92 and therefore into inlet 110 of the valve 20. Consequently, below the bypass pressure, the output of both the first and second stage pumps all flows through outlet port 106, which is communication with inlet 110. At and above the bypass pressure, the pressure inside the valve 20 flowing from port 110 to port 106 acts on pin 113 to shift pin 113 rightwardly as viewed in FIG. 3 which unseats ball 114 which is biased against seat 116 by ball holder 118 and spring 120. The spring 120 pushes at its rightward end against spring holder 122 which is screwed into valve block 100. The pressure at which ball 114 is unseated is adjustable by holder 122, which can be screwed in or screwed out to vary the force exerted on ball 114 and therefore the pressure at which the pin 113 will be shifted rightwardly to unseat ball 114.

When ball 114 is unseated, a flow path is opened between low pressure inlet port 102 and tank port 112. However, the degree of communication between the ports 102 and 112 depends upon the inlet pressure at port 110 which is acting on pin 113 and the clearance between the pin 113 and the block 100 between the ports 102 and 112, which is quite small to create a restriction (e.g., a 0.09 diameter pin may slide in a 0.123 diameter bore). Thus, the pressure at port 102 and therefore in passageway 64 is maintained above tank pressure by this restriction even with ball 114 unseated. This is necessary in the pump 10 since the pressure in passageway 64 must be maintained at a sufficient level (e.g., 150 psi) to supercharge the second stage cylinders 24 so that the second stage pistons 76 are returned in preparation for their compression stroke.

A sliding seal is created between pin 113 and block 100 by packing 126 provided around larger diameter intermediate section 127 of pin 113. The packing 126 includes an o-ring and a back-up ring sandwiched by steel rings pressed into bore 129 of block 100. Therefore, there is no substantial fluid communication between the ports 106 and 110 and the ports 102 and 112 past the packing 126. In addition, a pin keeper 128 encircles the left, smaller diameter end 130 of pin 113 and is biased against block 100 by compression spring 132. The keeper 128 allows pin 113 to slide within it, but abuts shoulder 134 of pin 113 to maintain pin 113 within the packing 126.

A port 124 is also provided in block 100 within which a nipple 125 is threaded to contain spring 132 and provide communication between the bypass valve 20 and a pressure relief valve (not shown) of any suitable type. A pressure relief valve is normally provided in pumps of this type to set an upper limit for the pressure output of the pump. At the relief pressure, the relief valve diverts flow from the output port 106 back to tank, as is well known.

Figure 4:
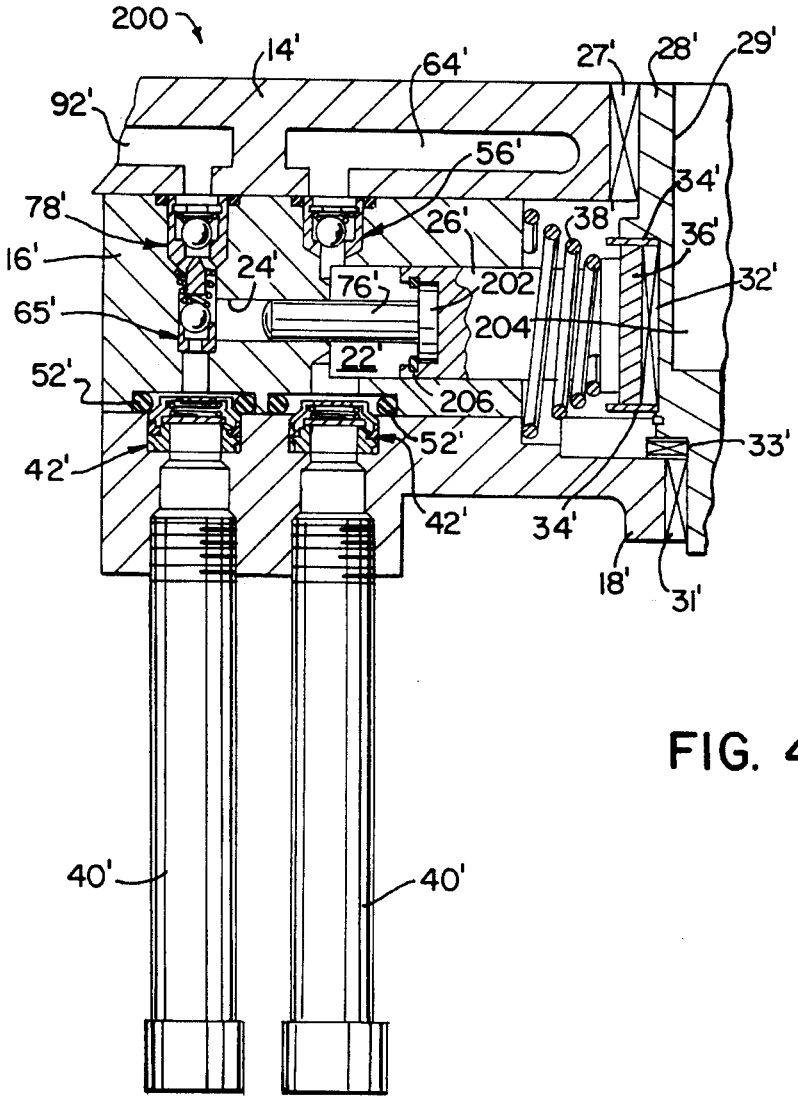
FIG. 4 is a fragmentary sectional view showing an alternate embodiment of the invention.

Referring now to FIG. 4, a second embodiment of the invention is disclosed. This embodiment is essentially the same as the pump 10, except that the second stage piston is not returned by a supercharge pressure but is returned by a loose connection between the second stage piston and the first stage piston. In the second embodiment 200 illustrated in FIG. 4, it should be understood that multiple sets of first and second stage pumps could be provided spaced around the axis of the crankshaft, just as three such sets are provided in the pump 10. Also in the pump 200, corresponding elements are identified by the same reference numeral as in pump 10 but with a single prime mark added.

In the pump 200, the second stage piston 76' has a flange 202 at its end 77' adjacent to the first stage piston 26' and the flange 202 is received in a correspondingly shaped recess in the face of the second stage piston 26'. The recess 204 in the end face of the piston 26' is slightly larger in diameter than the flange 202 so as not to create a rigid connection between the first and second stage pistons 26' and 76', but to allow for some relative movement. This relative movement is important because it is not practical or economical to make the axis of the first stage cylinder 22' exactly coaxial with the axis of the second stage cylinder 24 when machining those cylinders. Therefore, by allowing relative movement between the first and second stage pistons, minor degrees of noncoincidence between the axes of the first and second stage cylinders and pistons can be accommodated. To retain the flange 202 within the recess 204, an internal snap ring 206 is utilized which snaps into an internal annular groove of the recess 204, in well known fashion.

The embodiment 200 also differs from the embodiment 10 in that the flow through the second stage cylinder 24' is reversed. It is not necessary that this be the case, but since supercharging is not relied upon to return the second stage piston 76' in the pump 200, reversing the flow through the second stage cylinder 24' is an option.

This can be accomplished merely by reversing the orientation of the check valves 65 and 78 and providing the same type of intake pipe 40' and fast acting check valve 42' leading to the inlet to the second stage cylinder 24'. Thus, fluid from the tank 12 is sucked through the intake pipe 40' and fast acting check valve 42' and past ball 70' into the second stage cylinder 24'. On the compression stroke of the second stage piston 76', ball 70' reseats, ball 80' unseats and the fluid is compressed out of the second stage cylinder 24' past check 78' into passageway 92'. It should be noted that passageway 64', which receives the output of the first stage cylinders 22', is placed into communication with passageway 92' via a one way check valve (not shown) which would allow one-way flow from passageway 64' to passageway 92'. Passageway 92' would then be placed into communication with port 110 of a bypass valve 20 and passageway 64' would be placed in communication with port 102 of the bypass valve 20, with the other connections to the bypass valve 20 being the same as in pump 10.

Figure 5:
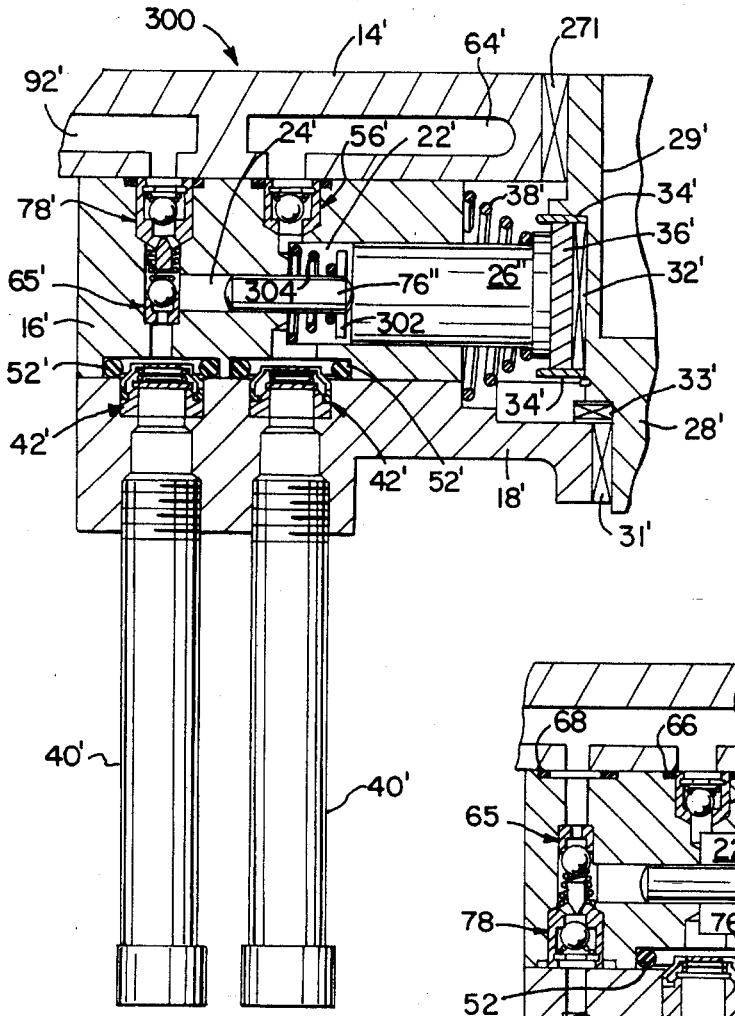
FIG. 5 is a fragmentary sectional view showing another alternate embodiment of a pump of the invention.

Pump 300 shown in FIG. 5 is a third embodiment of a pump of the invention. Pump 300 is essentially the same as pump 200, except that in pump 300 the second stage piston 76" has a flange 302 affixed to its end adjacent to first stage piston 26" and is spring biased for its return stroke by a conical compression spring 304.

Figure 6:
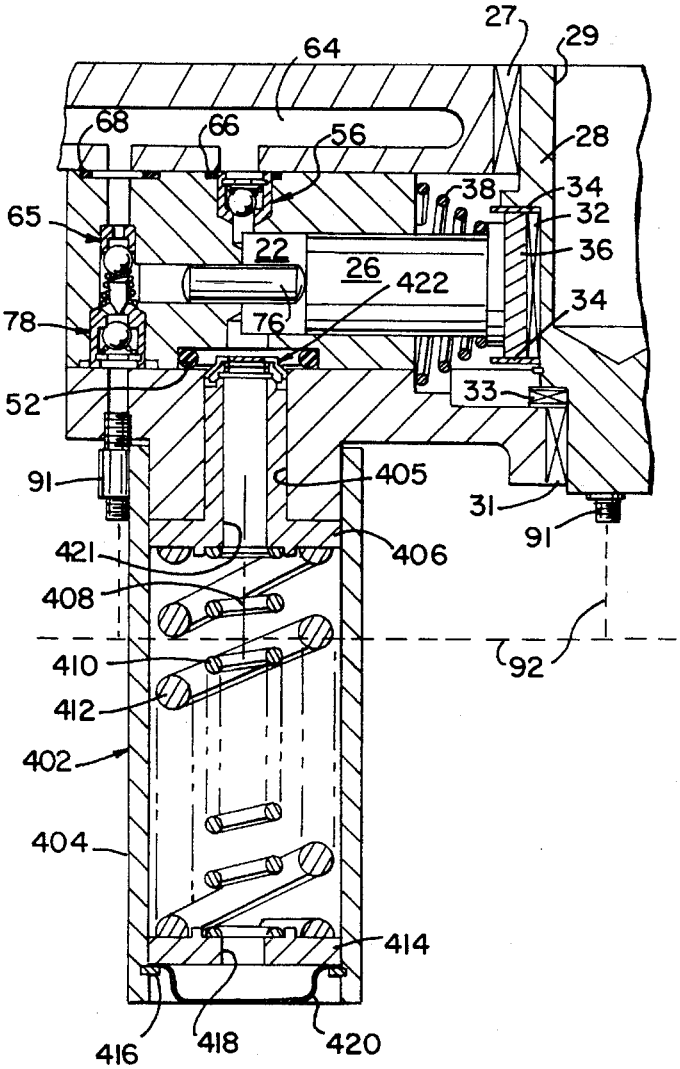
FIG. 6 is a fragmentary sectional view illustrating another modification to the pump of FIG. 1.

The embodiment 400 shown in FIG. 6 is essentially the same as the pump 10, except that for the intake to the first stage cylinder 22' an accumulator 402 is provided instead of an intake pipe 40 and fast acting check 42. The accumulator 402 has a canister 404 which is fixed in sealed engagement to the cover 18. A plunger 406 is reciprocable within canister 404 along axis 408. The plunger 406 creates a sliding seal with the bore 405 of cover 18 and is spring biased by two coaxial springs 410 and 412 against cover 18 so as to be biased toward reducing the working volume within the accumulator 402. At their lower ends the springs 410 and 412 push against backup plate 414 which is held in place by a snap ring 416. Plate 414 has a central hole 418 for inletting hydraulic oil to the canister 404 and a screen or other type of filter or strainer 420 overlies the inlet 418.

On the suction stroke of the first stage piston 26, hydraulic oil from below plunger 406 is sucked into the first stage cylinder 22 through lumen 421 of plunger 406 past a fast acting check valve 422 which is of the same type as the fast acting check valve 42, except with the seat formed by the upper end of the plunger 422. On the compression stroke of the first stage piston 26, the plunger 406 (with the check valve 422 now seated) is moved downwardly as viewed in FIG. 6, which compresses the springs 410 and 412. The plunger 406 continues to compress the springs 410 and 412 until the pressure within the first stage cylinder 22 exceeds the pressure in passageway 64. At that point and for the remaining portion of the compression stroke of the first stage piston 26, hydraulic oil is pumped from the first stage cylinder 22 into the passageway 64. On the return or suction stroke of the piston 26, the plunger 406 moves back upwardly until it reaches the position shown in FIG. 6 at which point more oil is drawn into the cylinder 22 from below the plunger 406 and past the check valve 422 to refill the cylinder 22 and prepare it for the next compression stroke.

At the beginning of the compression stroke of the piston 26, no oil is pumped past the check valve 56, and that continues to be the case until the pressure within the cylinder 22 exceeds the pressure in the passageway 64. During this time, the accumulator 402 is becoming charged. For example, if the pressure in passageway 64 is 1,000 psi, it may take one-third of the stroke of the piston 26 to generate 1,000 psi in the cylinder 22 because until 1,000 psi is reached the springs 410 and 412 are being compressed. After 1,000 psi is reached and for the remaining two-thirds of the compression stroke of the piston 26, oil is pumped past the check valve 56 into the passageway 64. Then, when the suction stroke of the piston 26 begins, for the first one-third of the suction stroke the plunger 406 rises until it reaches the position in FIG. 6, and thereafter for the remaining two-thirds of the suction stroke oil is drawn past the check valve 422 into the cylinder 22.

In the example given above, for the first third of the suction stroke when the plunger 406 is being returned to its position shown in FIG. 6 by the springs 410 and 412, the hydraulic fluid under pressure by virtue of the force exerted by the springs 410 and 412 exerts a force on the piston 26 which in addition to the spring 38 helps to return the piston 26. The force exerted on the piston 26 in turn is transmitted to the crankshaft 28 which, since the force is being transmitted on the suction part of the stroke of the piston 26, helps rotate the crankshaft 28 in the drive direction. Thus, during the first part of the suction stroke of the piston 26 in the pump 400, energy is being returned to the crankshaft 28 by the piston 26 to help drive the crankshaft 28. It should also be understood that an accumulator such as the accumulator 402 could also advantageously be applied to a single stage hydraulic pump in some applications. Also, while a spring biased plunger has been disclosed, it should be understood that other types of accumulators, for example an air biased type, could be employed. In addition, while the accumulator is shown as separate from the piston 26, an accumulator could be built into the piston 26. Finally, the inlet check 422 need not be provided as part of the plunger 406, but could be provided elsewhere so as to inlet fluid from the tank 12 to the cylinder 22 on the suction stroke of the piston 26.

The accumulator 402 reduces output flow as the pressure within passageway 64 (i.e., the output pressure of the cylinder 22) increases, since higher pressures cause more deflection of the springs 410 and 412 and consequently cause more fluid to be pumped into the working chamber of the accumulator 402, which reduces the output flow from cylinder 22 into the passageway 64. As the flow output is decreased in this manner, the energy requirement from the prime mover which drives crankshaft 28 is reduced by virtue of reduced pumping chamber pressures through the initial portion of the compression stroke and also by the return of energy to the crankshaft as explained above during the initial stages of the suction or intake stroke. It is important to reduce pumping pressures in the initial portion of the compression stroke because that is where the drive angle between the lobe 30 and the piston 26 produces the highest moment arm, which is proportional to the reaction torque exerted by the piston 26 on the shaft 28.

Because of the efficiencies gained by using an accumulator such as the accumulator 402, the bypass pressure at which valve 20 relieves the pressure in passage 64 can be increased for a given horsepower relative to a pump not having an accumulator 402. As compared to a gear or gerotor type pump, efficiency is particularly improved just below the bypass pressure (especially at higher bypass pressures) because rather than the output flow being reduced by leakage past the gear or gerotor teeth, it is reduced by accumulator action and much of the energy in charging the accumulator is returned to the crankshaft on the suction stroke of the first stage piston. It should also be noted that the performance curve of a pump 400 utilizing an accumulator 402 can be easily tailored to stay within power limitations of the prime mover throughout a certain pressure range while maximizing output flow by an appropriate selection of springs 410 and 412, the surface area of the accumulator plunger 406 and/or the stroke of the accumulator plunger 406.

Figure 7:
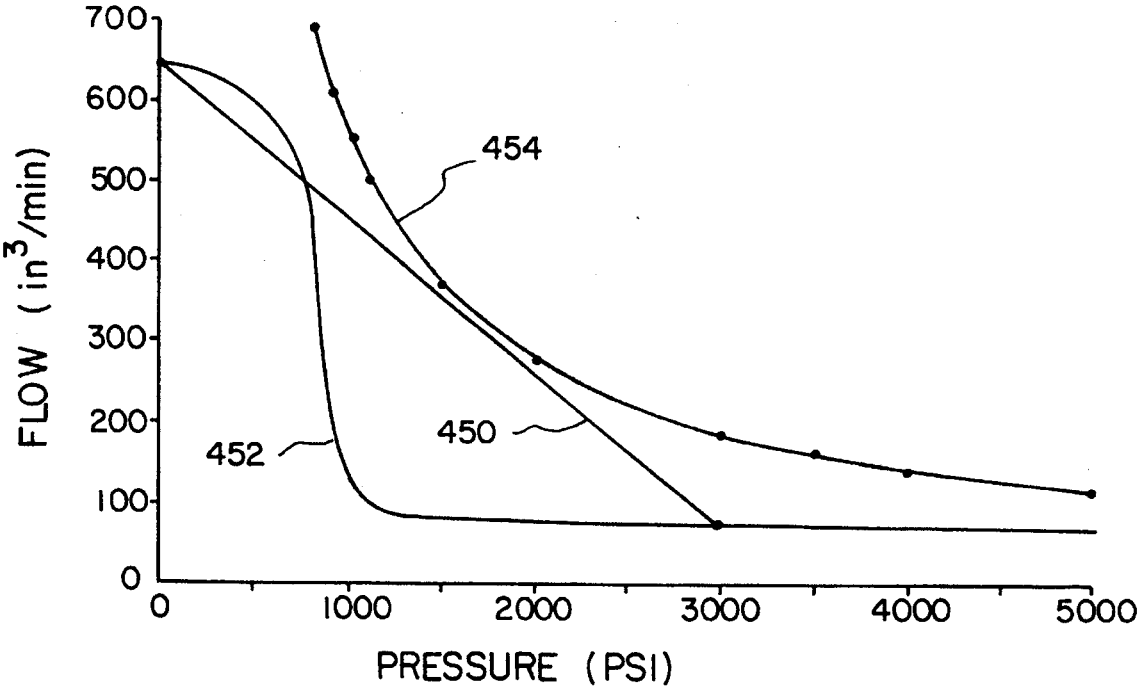
FIG. 7 is a schematic graph illustrating how an accumulator alters the performance characteristics of a reciprocating pump.

FIG. 7 graphically compares the effect on the pressure-flow curve of a pump having an accumulator (curve 450) to a pump without an accumulator (curve 452). Curve 454 represents a constant horsepower curve, i.e., the plot of points at which the product of flow rate and pressure is a constant. Referring to curve 452, at approximately 700 psi the bypass valve opens, which results in a large drop in output flow, from approximately 570 $in^3$/min to approximately 70 $in^3$/min over the range of pressures from approximately 700 psi to approximately 1200 psi. In this range of pressures, there is a relatively large area between the curves 452 and 454, which means that the available horsepower is not being efficiently utilized. In contrast, the curve 450 more closely approximates the curve 454 above approximately 750 psi so that a larger percentage of available horsepower is used above this pressure, up to 3000 psi, where the bypass valve for the pump with the accumulator would open. At this pressure and above, the curves 450 and 452 are the same, while below approximately 750 psi the pump without the accumulator uses somewhat more of the available power than the pump with the accumulator. Thus, it can be seen that an accumulator allows using a higher percentage of available horsepower of a pump over a substantial pressure range and allows increasing the bypass pressure.

Thus, the invention provides an efficient pump which can be made in a relatively small package, not significantly larger than a comparable single stage pump, and with fewer and less expensive parts than comparable first stage gear or gerotor type pumps. The improvement in efficiency in the first stage over a gear or gerotor type pump typically used for two stage pumps allows for higher bypass pressures and therefore more efficient overall operation. In effect, more efficient utilization of horsepower is achieved in the lower pressure ranges, before the bypass valve opens. Also, a pump of the invention is less sensitive to damage caused by contamination or cavitation than a gear or gerotor pump.

Preferred embodiments of the invention have been described in considerable detail. Many modifications and variations of these embodiments will be apparent to those of ordinary skill in the art but which will still incorporate the spirit of the invention. Therefore, the invention should not be limited to the embodiments described, but should be defined by the claims which follow.

We claim:

1. In a two stage hydraulic pump of the type having multiple sets of two stage pumps, each said set having a first stage pump for delivering a hydraulic fluid flow of a relatively high volume and low pressure and a second stage pump for delivering a hydraulic fluid flow of a relatively low volume and high pressure, the improvement wherein:

each said first stage pump is a reciprocating piston pump having a first stage piston reciprocable in a first stage cylinder;

each said second stage pump is a reciprocating piston pump having a second stage piston reciprocable in a second stage cylinder;

each said second stage piston is driven by said first stage piston to compress said fluid in said second stage cylinder;

a manifold;

at least one valve providing one-way communication from at least two of said first stage cylinders to said manifold; and at least one valve providing one-way communication from said manifold to at least two of said second stage cylinders;

wherein said manifold distributes flow from said at least two first stage pumps to said at least two second stage pumps so as to supercharge said second stage pumps with fluid pumped through said manifold by said first stage pumps.

2. The improvement of claim 1, wherein said first and second stage pumps are substantially coaxial.

3. The improvement of claim 2, wherein said first and second stage pistons are separate and distinct from one another.

4. The improvement of claim 3, wherein the first stage pistons of said multiple sets are driven by a common shaft.

5. The improvement of claim 4, wherein the shaft has an eccentric lobe which drives said first stage pistons.

6. The improvement of claim 1, wherein three sets of two stage pumps are provided, a reciprocating axis of each set is offset from a reciprocating axis of the next adjacent set by approximately 120°, and the first and second stage pumps of all three sets communicate through said valves with said manifold.

* * * * *